US006224342B1

(12) United States Patent
Russell et al.

(10) Patent No.: US 6,224,342 B1
(45) Date of Patent: May 1, 2001

(54) CONDUIT PUMP SYSTEM TO INCREASE WATER FLOW CAPACITY

(75) Inventors: Samuel Oliver Russell, Salt Spring Island; Arthur James Louie, Richmond, both of (CA)

(73) Assignee: City of Richmond, Richmond (CA)

( * ) Notice: Subject to any disclaimer, the term of this patent is extended or adjusted under 35 U.S.C. 154(b) by 0 days.

(21) Appl. No.: 09/414,050

(22) Filed: Oct. 6, 1999

(51) Int. Cl.[7] ..... F04F 1/18; E03B 7/00; E03B 5/00

(52) U.S. Cl. ..... 417/108; 137/236.1; 137/565

(58) Field of Search ..... 417/108; 137/236.1, 137/561 R, 565; 138/111, 112, 39, 46; 251/61.1; 405/36, 37

(56) References Cited

U.S. PATENT DOCUMENTS

| | | | | |
|---|---|---|---|---|
| 1,035,955 | * | 8/1912 | Freeman | 417/108 |
| 3,661,261 | * | 5/1972 | Lemke | 210/83 |
| 4,810,130 | | 3/1989 | Brombach et al. | 405/80 |
| 4,911,849 | | 3/1990 | Labesque et al. | 210/747 |
| 4,997,312 | * | 3/1991 | Regan | 405/37 |
| 5,083,885 | | 1/1992 | Ushitora et al. | 405/36 |
| 5,100,266 | | 3/1992 | Ushitora et al. | 406/120 |
| 5,595,457 | * | 1/1997 | Stucks | 405/87 |
| 5,752,785 | | 5/1998 | Tanaka et al. | 405/52 |

* cited by examiner

*Primary Examiner*—Timothy S. Thorpe
*Assistant Examiner*—Michael K. Gray
(74) *Attorney, Agent, or Firm*—Klarquist Sparkman Campbell Leigh & Whinston LLP

(57) ABSTRACT

An apparatus for increasing the flow of liquid in a conduit provides a barrier positioned in the conduit to prevent flow of liquid past the barrier in a lower region and defining a gap region above that lower region and adjacent the barrier. A duct having a first end for positioning within the lower region of the conduit upstream of the barrier and a second end for positioning in the gap region of the conduit to direct the flow of liquid through the duct from an area upstream of the barrier through the gap region to an area downstream of the barrier. An air pump communicates with the duct to force air into the first end of the duct under sufficient pressure to mix with water in the area of the first end of the duct and rise with the water through the duct and out the second end of the duct to the downstream side of the barrier. A plurality of apparatuses may be located at pre-determined intervals along the conduit.

30 Claims, 14 Drawing Sheets

CONDUIT PUMP SYSTEM TO INCREASE WATER FLOW CAPACITY

BACKGROUND OF THE INVENTION

This invention relates to a system for increasing the flow of liquid in a conduit such as a storm sewer system, and in particular relates to a system incorporating a series of barriers and air pumps which lift a portion of the liquid from the upstream side of each barrier to the downstream side.

Water resulting from rainfall or snowmelt or the like is usually removed from urban areas by means of an array of drainage conduits, often referred to as a storm sewer system. These conduits collect the water from the urban area serviced by that system and direct the flow through the system for discharge into a river, lake, reservoir or other suitable location. Urban development into new areas includes the construction of drainage conduits to service that new area. Those conduits often connect with existing storm sewer systems to transport water from those urban areas to the discharge location. This increases the volume of water flowing in existing systems and as development increases, waterflow volume will eventually exceed the capacity of the conduits in that system. This is particularly problematic during periods of heavy rainfall. It can also occur as a result of increased urbanization and the resultant increase in pavement and drainage gutters in those urban areas which link to existing drainage systems. The inability of existing systems to handle the increased water flow causes flooding in the drainage basin as water backs up. This flooding can result in damage to homes, vehicles and other objects within that flooded drainage basin which leaves municipalities with the problem of expanding existing storm sewer systems to adequately handle the increased flow of water in those systems.

One common method of increasing the capacity in rain water drainage conduits is to replace smaller capacity conduits with larger capacity conduits which are sufficient to handle the increased water flow. Another method of increasing the capacity of the entire drainage system is to provide additional conduits by "twinning" existing conduits to split the water flow among several conduits operating generally in parallel flow to accept the increased water flowing from the drainage basin. However increasing the flow capacity in these manners involves considerable capital expenditure and inconvenience caused by construction of these additional or increased capacity replacement conduits within an existing rain water drainage conduit system.

The need for an increased capacity rain water drainage system often occurs only during relatively short periods of time during heavy rainfall which results in flooding as the water accumulating in the drainage basin exceeds the flow capacity of the conduit system.

Accordingly there is a need for a conduit drainage system and method which increases the flow of liquid within an existing conduit system during periods of heavy water flow which flow would otherwise exceed the capacity of the conduit. Such a system would be activated only during periods of increased water flow, such as occurs during heavy rainfall exceeding the normal capacity of the conduit system.

There is further a need for such a system and method for increasing the flow of liquid within a conduit which is easily adapted to a variety of existing conduits of rain water drainage systems without requiring significant modification to the conduits and without interfering with the flow of liquid in the conduit during periods when flow within the conduit is within the normal capacity of the conduit.

Because these periods of increased water flow which exceed the capacity of existing conduits do not occur very often, the efficiency of the system in increasing the flow of water is less important as compared to the significant capital cost which would be required to replace or twin the existing conduit system with one of increased capacity to accept and transport an equivalent increased flow amount.

Air lift pumps are well known in the art and are used generally for lifting a liquid to higher level by using air pressure. The air is directed into a lower level of the pump where the liquid has accumulated. The air under pressure forces the liquid through the pump from the lower level to be discharged from the pump at a higher level. Air lift pumps operate on the principle that a mixture of air and water will rise in a pipe surrounded by water as the mixture of water and air in the pipe is lighter than the water outside the pipe.

While air lift pumps are considered to be relatively inefficient for lifting water as compared to submersible pumps, they do have advantages over these other types of pumps in that they do not have any moving parts and they take up very little cross sectional space within the conduit. The air compressor may be placed outside of the conduit with an air line providing the pumping energy into the water to pump it upwardly. These features permit easy retrofitting of an existing storm conduit system with a series of pumps to increase the flow capacity of liquid within that system with minimal construction cost. This also facilitating ongoing maintenance of the system by allowing maintenance of the compressor from outside the conduit system itself with minimal maintenance required within that system.

SUMMARY OF THE INVENTION

This invention provides an apparatus for increasing the flow of liquid in a conduit. The apparatus includes a barrier suitable for positioning in the conduit to prevent flow of liquid past the barrier in a lower region of the conduit, the barrier defining a gap region of the conduit above the lower region and adjacent the barrier, the gap region permitting flow of liquid from upstream of the barrier to downstream of the barrier. A duct includes a first end for positioning with the lower region of the conduit upstream of the barrier and a second end for positioning in the gap region of the conduit, to direct the flow of liquid through the duct from an area upstream of the barrier through the gap region to an area downstream of the barrier. An air lift pump communicates with the duct to force air into the first end of the duct under sufficient pressure to mix with water in the area of the first end of the duct and rise with the water through the duct and out the second end of the duct to the downstream side of the barrier.

Alternatively, the duct can include a plurality of parallel, aligned pipes, each pipe extending from the first end to the second end of the duct for directing a portion of the flow of liquid through the pipe from an area upstream of the barrier through the gap region to an area downstream of the barrier.

An alternate embodiment of the invention provides a barrier which includes an upstream section preventing flow of liquid in a portion of the lower region, a downstream section preventing flow of liquid in the rest of the lower region and a connecting section connecting the upstream section to the downstream section preventing flow of liquid in the lower region between the upstream and downstream sections. The connecting section may include a downstream and upstream side with a duct positioned adjacent the connecting section such that the first end of the duct is adjacent the upstream side of the connecting section and the second end of the duct is positioned to direct liquid to the downstream side of the connecting section. The duct may be angled with respect to a plane perpendicular to the longitudinal axis of the conduit with the first end positioned closer to the upstream section than the second end. The duct may further be angled with respect to the plane of the connecting section with the first end positioned further away from the connecting section than the rest of the duct.

DETAILED DESCRIPTION

Figure 1:
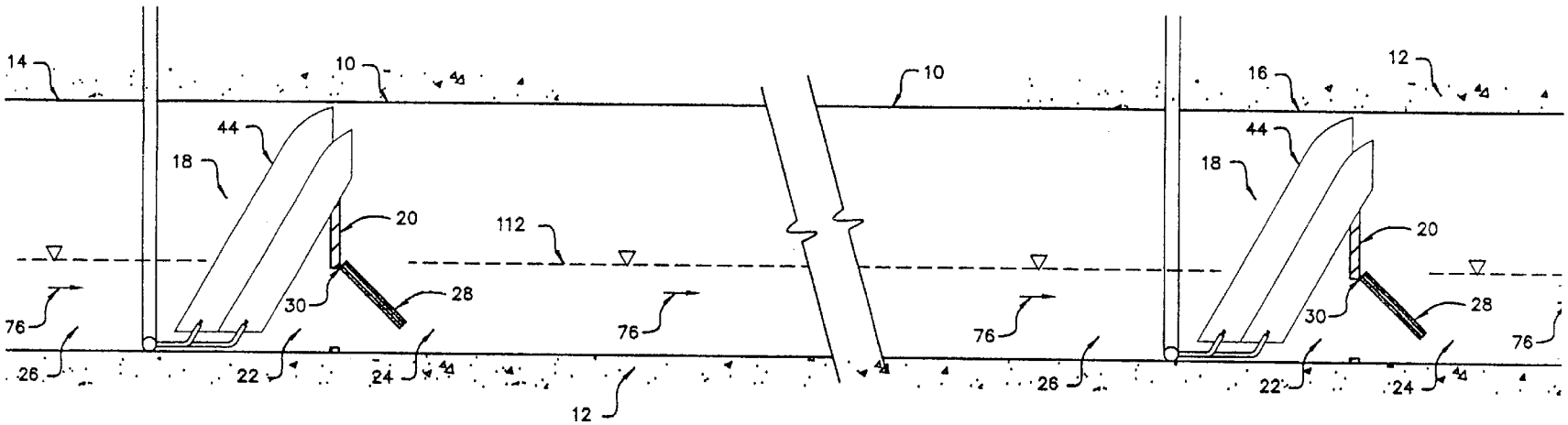
FIG. 1 is a schematic side view of a conduit which includes two apparatuses of this invention for increasing the flow of liquid in that conduit, showing the bypass flap gates in an open position.
Figure 2:
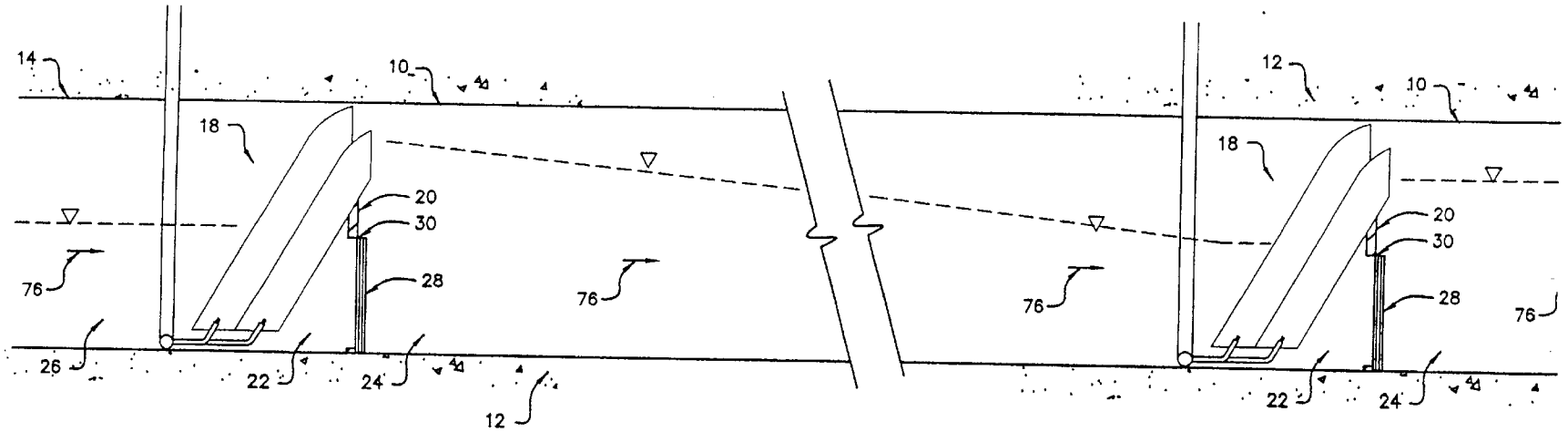
FIG. 2 is the conduit of FIG. 1 showing the flap gates of the apparatuses in a closed position.

Referring initially to FIGS. 1 and 2, conduit 10 represents a conduit for transporting liquid from an upstream area of origin of that water to a downstream area for discharge of the water into a river, lake, reservoir or other suitable place. Conduit 10 may be a component of a storm sewer system located below the surface and surrounded by earth 12. Conduit 10 is sloped gradually downwardly from its upstream end 14 as compared to its downstream end 16. This facilitates flow of water along conduit 10 from upstream end 14 to downstream end 16.

A pair of apparatuses 18 for increasing the flow of liquid in conduit 10 are positioned in a spaced, aligned relationship within conduit 10. A plurality of apparatuses 18 are positioned along conduit 10 at periodic intervals, as desired or as required in order to increase the flow capacity of the system. The selection of the number of apparatuses 18 and the distance between apparatuses will be readily determinable by those skilled in the art and depend on the flow capacity of a particular conduit and the increased flow requirements of the system generally.

Apparatus 18 includes barrier 20 of appropriate dimension to fit within conduit 10 and prevent flow of water from an upstream side 22 of the barrier to a downstream side 24 of the barrier.

Barrier 20 includes flap gate 28 hingedly connected to barrier 20 at hinge 30. As depicted in FIG. 1, flap gate 28 is in a closed position preventing flow of water in lower region 26 from downstream side 24 of barrier 20 to upstream side 22. Flap gate 28 is in a closed position during periods of increased water flow within conduit 10 such as occurs during periods of heavy rainfall in the drainage area.

Figure 5:
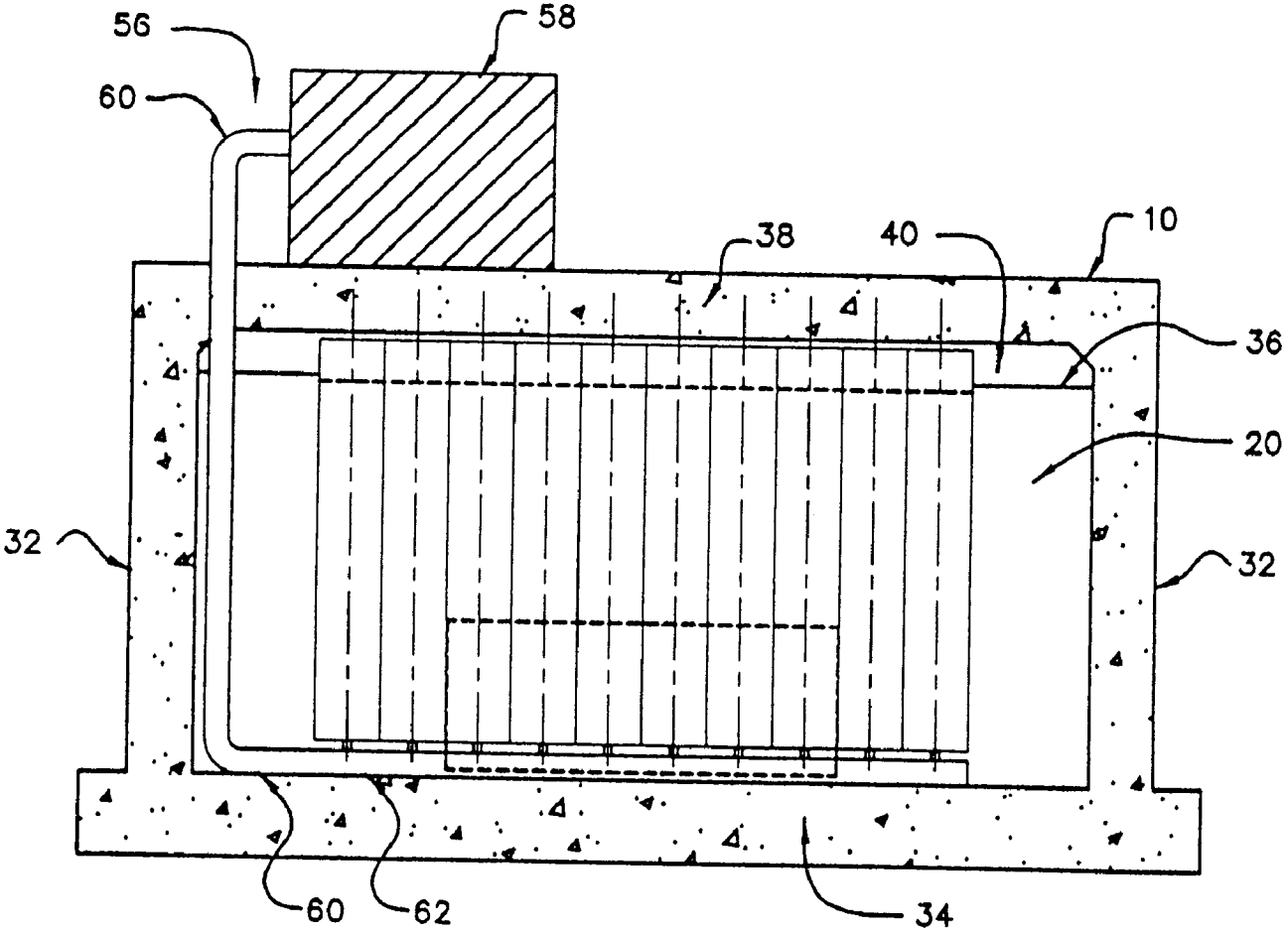
FIG. 5 is a plan view of the apparatus of FIG. 3, along line 5—5 of FIG. 3.

FIG. 2 depicts flap gate 28 in an open position permitting water in lower region 26 of conduit 10 to flow from upstream side 22 to downstream side 24 of barrier 20. As best seen in FIG. 5, barrier 20 extends from lower wall 34 of conduit 10 upwardly in sealing engagement with walls 32 to upper end 36 of barrier 20. Upper end 36 is spaced from upper wall 38 of conduit 10 and forms a gap region 40 in conduit 10.

Figure 3:
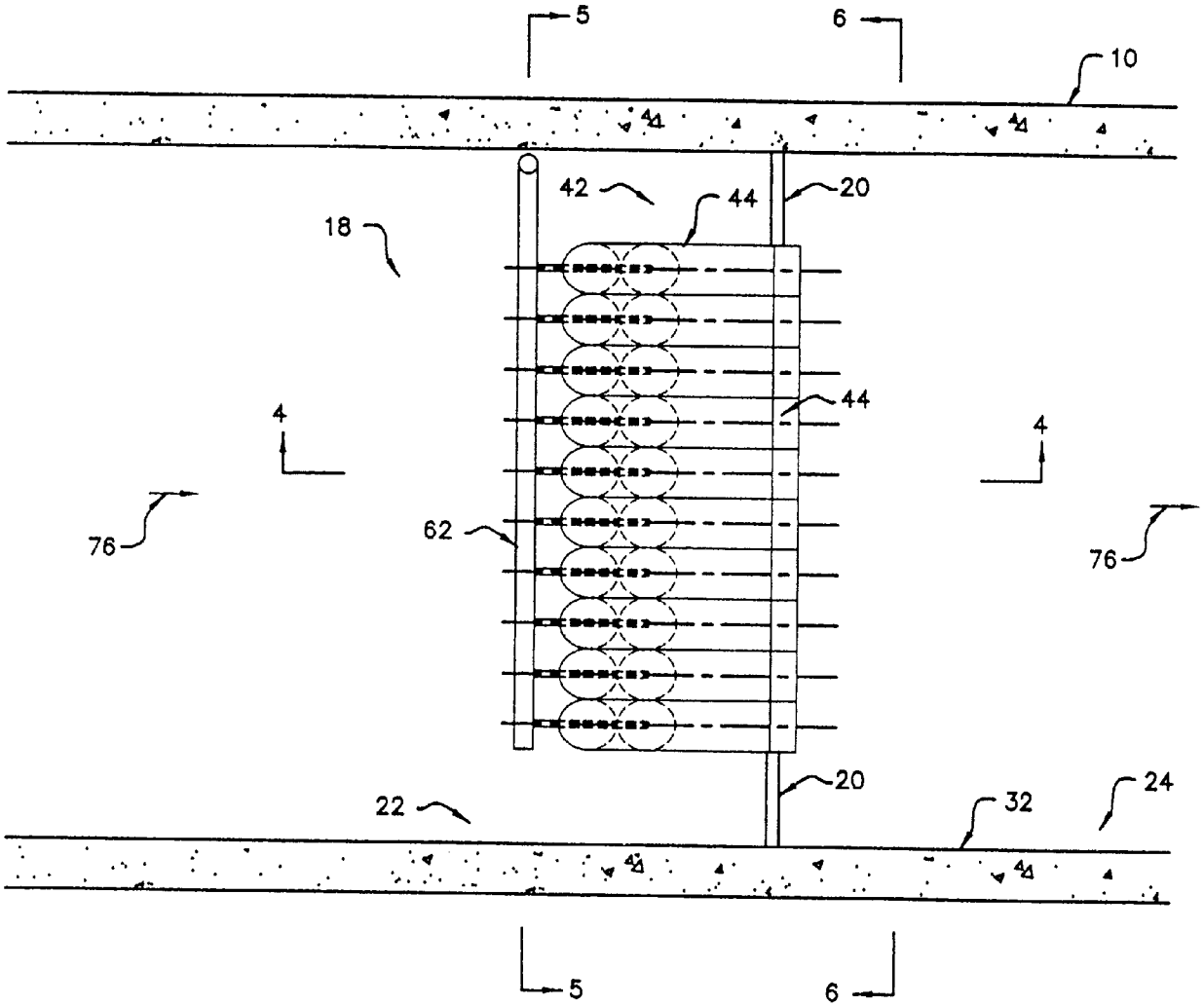
FIG. 3 is a top plan view of an apparatus of a first preferred embodiment of the invention depicted in FIG. 1.
Figure 4:
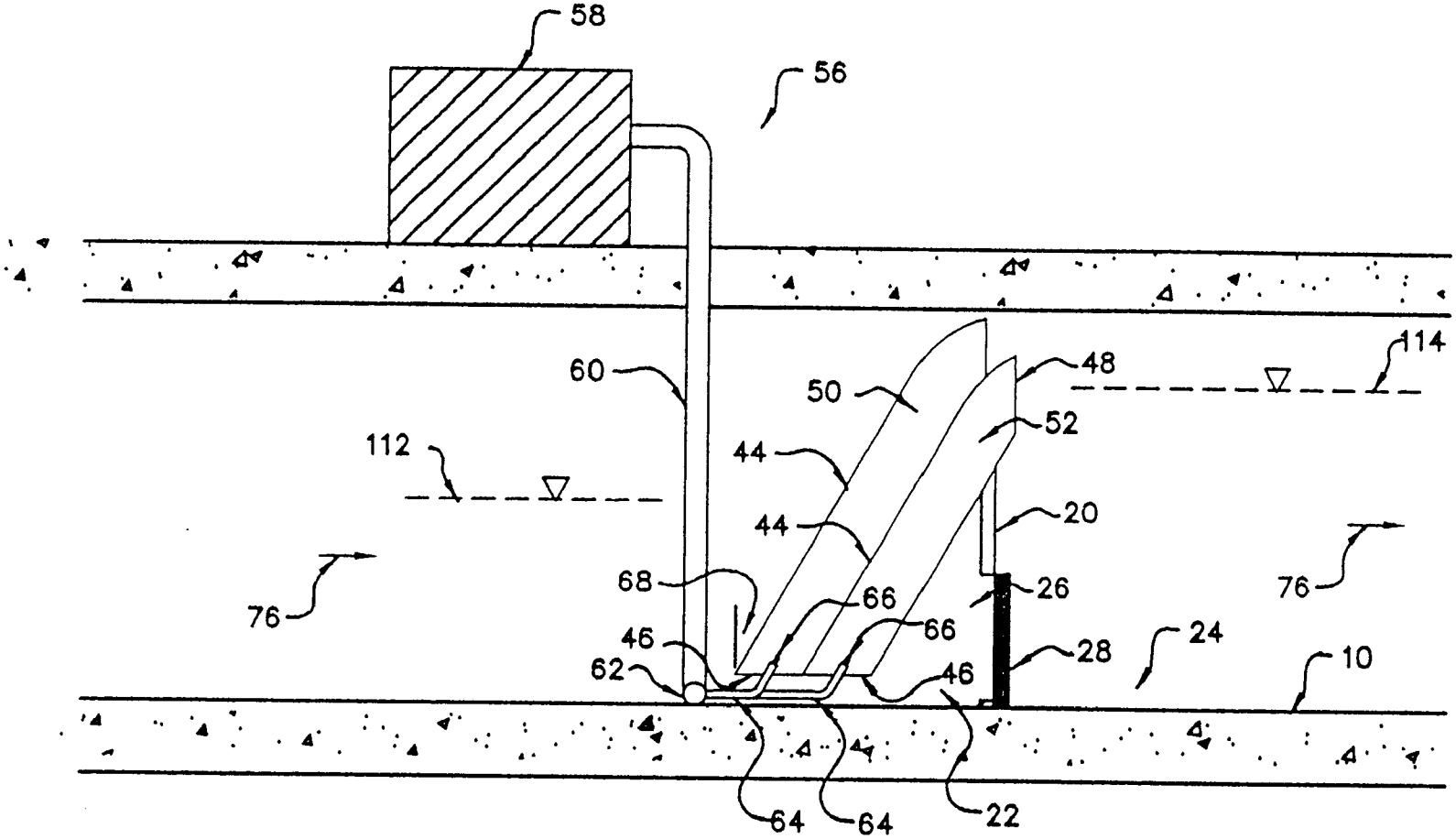
FIG. 4 is a side sectional view of the apparatus of FIG. 3, along line 4—4 of FIG. 3.
Figure 14:
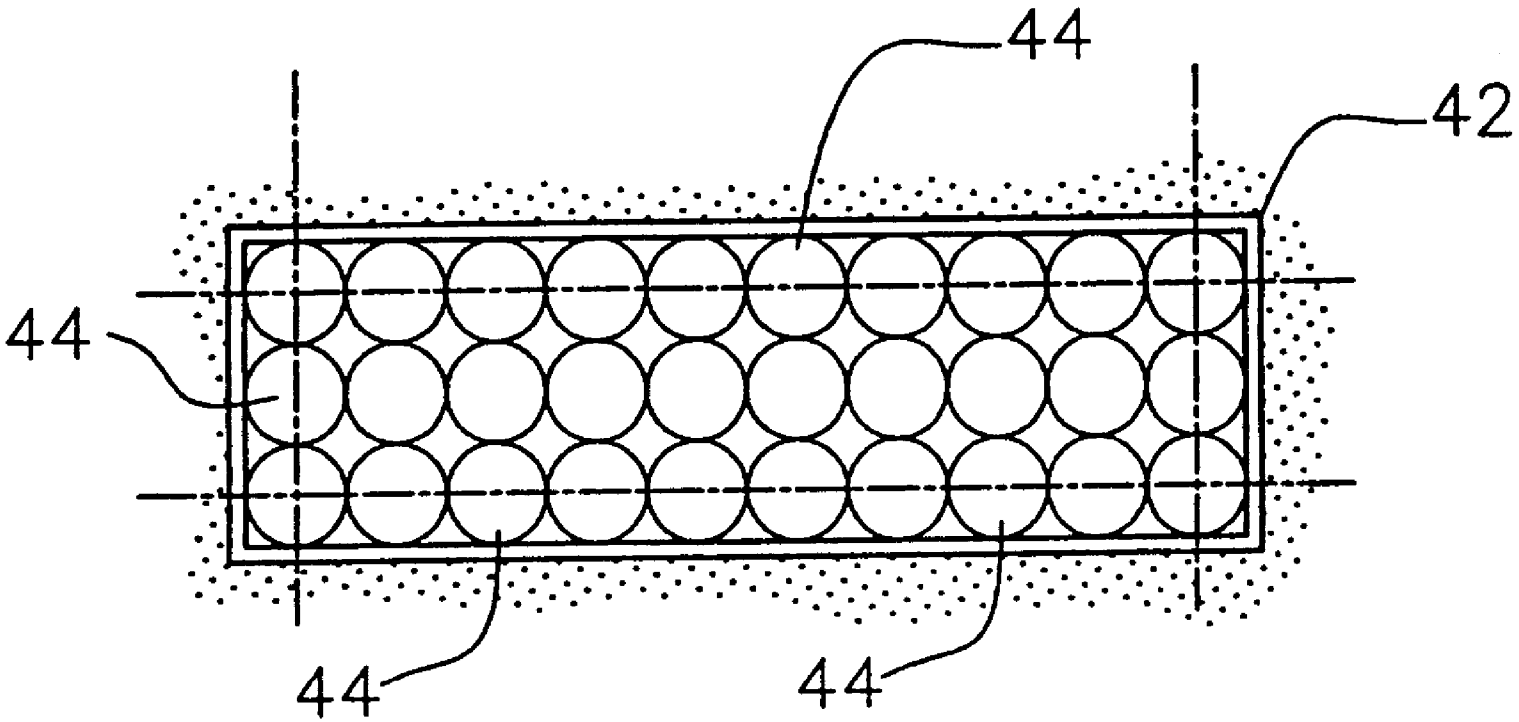
FIG. 14 is a close-up sectional view of an array of ducts of the discharge end of FIG. 12.

Referring to FIG. 3, apparatus 18 includes a duct 42 comprised of a plurality of parallel aligned pipes 44. The positioning of pipes 44 within duct 42 is best seen in FIG. 14. FIG. 14 depicts pipe 44 in parallel alignment with three pipes 44 deep and ten pipes 44 wide forming an array of thirty pipes 44. Other numbers of pipes 44 and rows of pipes 44 may be employed without departing from the invention, including an array of two pipes 44 deep and ten pipes wide as depicted in FIGS. 3 and 4. An array of pipes 44 is preferred over a single pipe of equivalent cross-sectional area as the array, because turbulence of the water and air mixture flowing in an array of pipes 44 is significantly less than a single pipe.

As best seen in FIG. 4, pipes 44 include first or lower end 46 positioned within lower region 26 of conduit 10 at upstream side 22 of barrier 20. Upper end 48 of pipes 44 extend through an upper region of barrier 20, partially above barrier 20 into gap region 40 and partially to permit discharge of liquid through pipes 44 into the downstream side 24 of barrier 20 at higher region 27 located above lower region 26 but at the downstream side of barrier 20.

Figure 6:
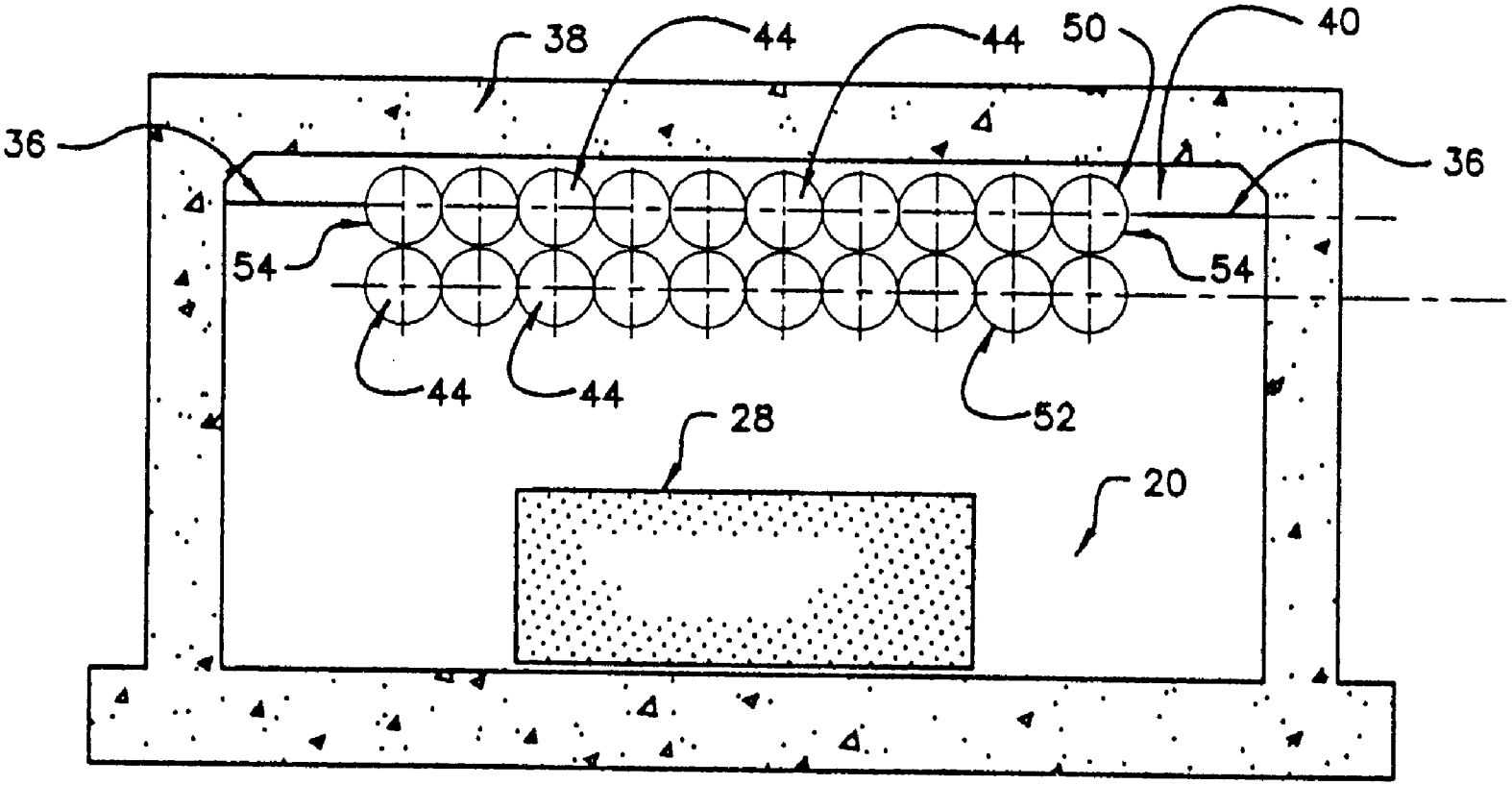
FIG. 6 is a plan view of the apparatus of FIG. 3, along line 6—6 of FIG. 3.

Pipes 44 of the embodiment depicted in FIGS. 3, 4, 5 and 6 include upper row 50 and lower row 52. Referring to FIG. 6, pipes 44 of upper row 50 partially extend into gap region 40. The lower portion 54 of upper row 50 passes through barrier 20. Lower row 52 of pipes 44 extend through openings in barrier 20 so that upper end 48 extends into higher region 27 of downstream side 24 of barrier 20. However, it would be apparent to one skilled in the art that upper end 36 of barrier 20 may be positioned further from upper wall 38 to provide a larger gap region 40 sufficient to receive both rows 50 and 52 of pipes 44 above barrier 20. In that way no openings are required to be formed within barrier 20. Similarly, it would be apparent to one skilled in the art that both rows of pipes, 50 and 52 may extend through barrier 20 in the manner in which lower row 52 extends through barrier 20 in FIG. 6 by lowering rows 50 and 52 as compared to that depicted in FIG.6. This could also be accomplished by reducing the size of gap region 40 by increasing the dimensions of barrier 20 which would raise the position of end 36 upwardly closer to upper wall 38.

Referring to FIG. 4, compressed air is supplied into pipes 44 by means of compressed air system 56. System 56 includes air compressor unit 58 located in an area outside of conduit 10. Air pipe 60 extends from unit 58 into conduit 10 downwardly to the bottom of conduit 10 adjacent lower wall 34 (see FIG. 5). Preferably pipe 60 is positioned adjacent to wall 32 of conduit 10 when in a vertical direction and lower portion 62 is positioned adjacent to lower wall 34 when in a horizontal direction to minimize interference with water flow within conduit 10. Lower portion 62 is connected to a plurality of smaller diameter air passages 64 which are, in turn, connected to air nozzles 66. Air passages 64 extend horizontally along lower wall 34 in region adjacent lower portion 62 and then bend upwardly, angled from the vertical, to extend into lower end 46 of pipes 44. Preferably nozzle 66 is positioned along the central axis of each pipe 44 to direct compressed air into lower end 46 of each pipe 44 along that central axis.

Figure 7:
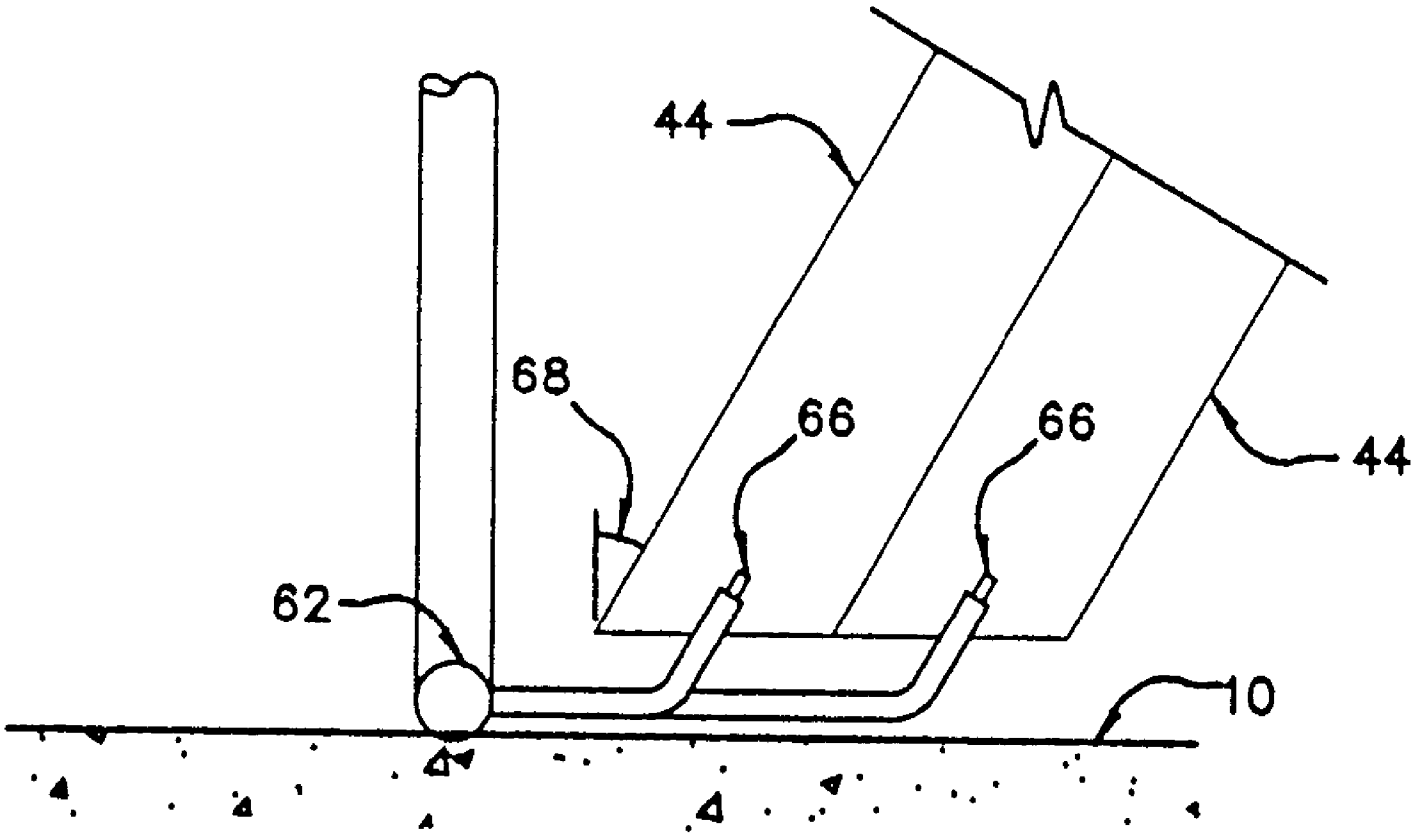
FIG. 7 is a close-up side view of the air nozzle input into the inlet and of the duct of the apparatus of FIG. 3.

Pipes 44 are angled at an offset angle 68 from the vertical that is they are angled from a plane defined by barrier 20 which is perpendicular to walls 34 and 38 of conduit 10. Pipes 44 are angled at an offset angle 68 from the vertical. This positions pipes 44 in a manner which facilitates flow of water from upstream side 22 to downstream side 24 of barrier 20. Nozzles 66 are positioned at the same angle as the offset angle 68 of pipes 44 to ensure that compressed air flowing from nozzles 66 flows initially into pipes 44 axially along the longitudinal axis of pipes 44. FIG. 7 provides a close up view of pipes 44, offset angle 68 and the orientation of nozzles 66 with respect to pipes 44.

Preferably offset angle 68 is between 45 and 30 degrees and optimally is about 30 degrees.

An alternate embodiment of the invention will now be discussed with reference to FIGS. 8 through 11. The alternate embodiment permits an increase in duct 42 size, or an increase in the number of pipes 44 beyond that of the first embodiment. The width of the duct 42 and of the number of pipes which may fit across barrier 20 in the first embodiment is constrained by the width of conduit 10.

Figure 8:
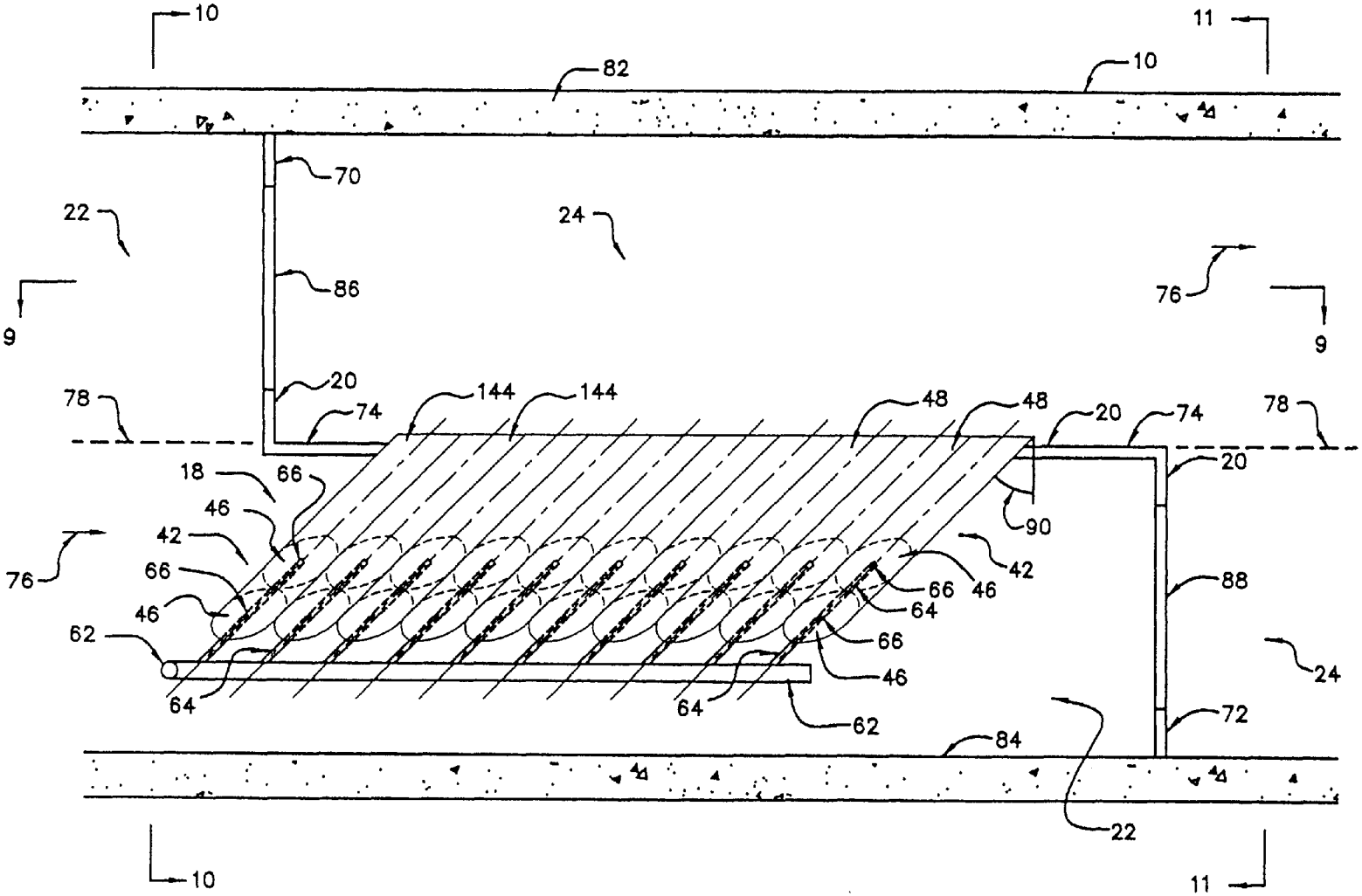
FIG. 8 is a top plan view of an apparatus of an alternate preferred embodiment of this invention.

Referring to FIG. 8, barrier 20 is comprised of three components, upstream section 70, downstream section 72 and connecting section 74. Upstream section 70 extends in a direction perpendicular to the direction of water flow 76. Upstream section 70 is attached in sealing engagement with left wall 82 of conduit 10 and extends perpendicularly therefrom towards center line 78 of conduit 10.

Downstream section 72 is attached in sealing engagement with right wall 84 and extends towards the center line 78 of conduit 10, perpendicular to right wall 84 and the direction of water flow 76.

Connecting section 74 extends between upstream section 70 and downstream section 72 in sealing engagement with upstream and downstream sections 70 and 72. Connecting section 74 positioned at or near the center line 78 and extends parallel thereto between upstream and downstream sections 70 and 72.

The barrier 20 of the alternate embodiment defines upstream side 22 of barrier 20 and downstream side 24 of barrier 20.

Figure 10:
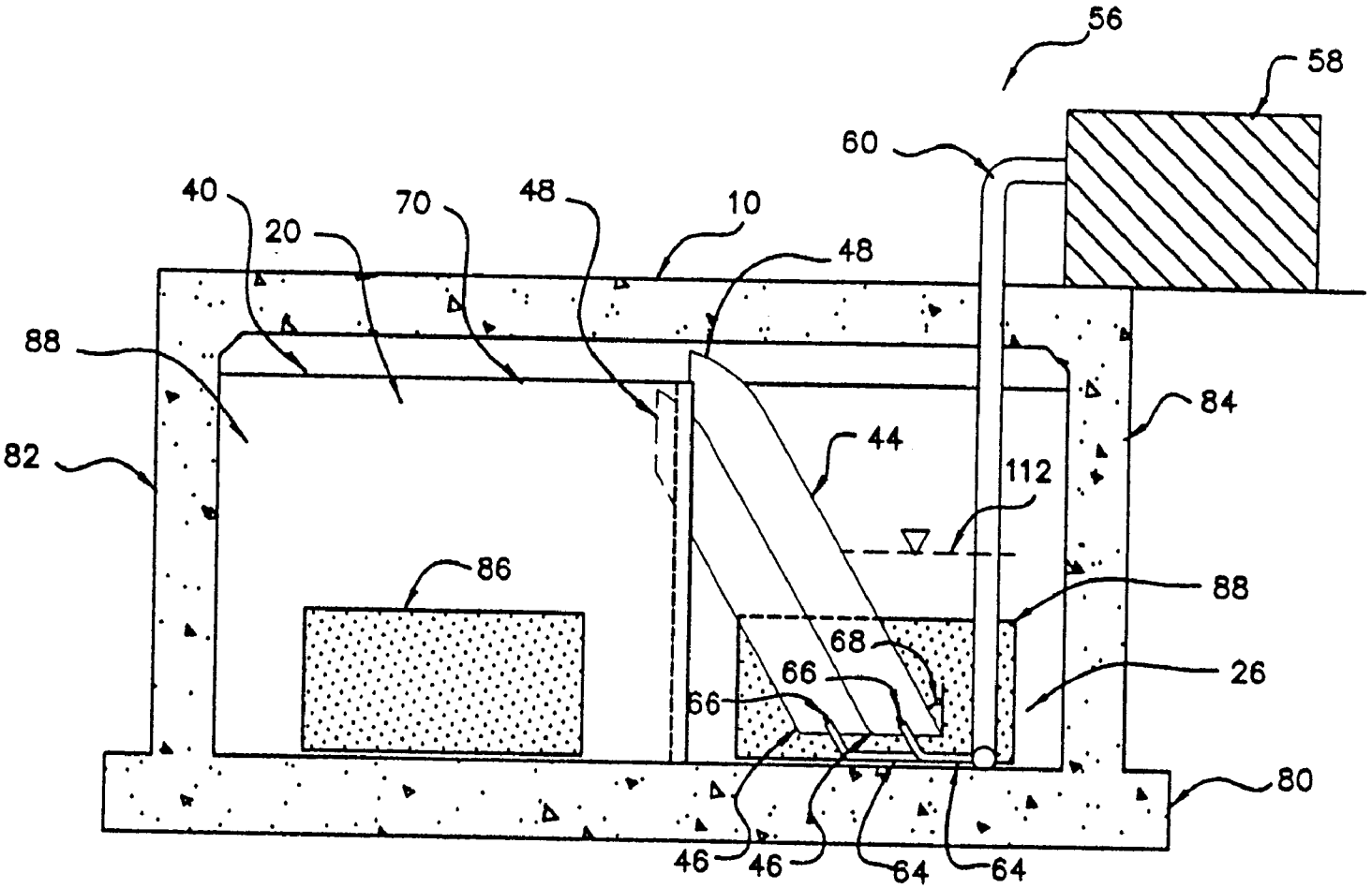
FIG. 10 is a plan sectional view of the apparatus of FIG. 8 taken along line 10—10 of FIG. 8.
Figure 11:
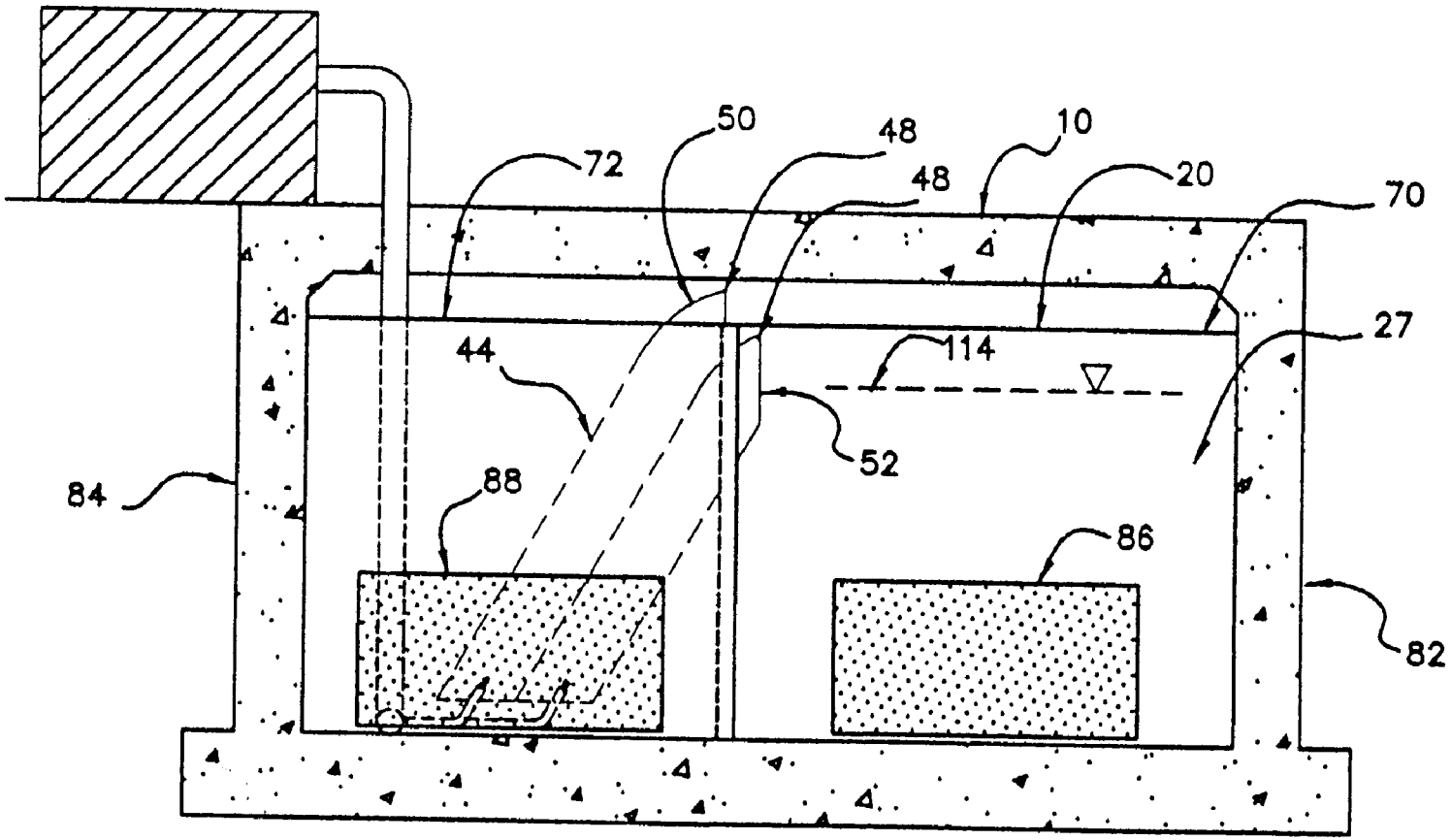
FIG. 11 is a plan view of the apparatus of FIG. 8, taken along line 11—11 of FIG. 8.

As best seen in FIGS. 10 and 11, upstream section 70 includes upstream flap gate 86 and downstream section 72 includes downstream flap gate 88. Flap gates 86 and 88 are in an open position, similar to that as depicted in FIG. 2 with respect to the first embodiment, to permit water to flow past barrier 20 during periods of relatively normal waterflow through conduit 10. Flap gates 86 and 88 are closed to prevent flow of water through gates 86 and 88 during periods of heavy water use when water flow approaches or exceeds the maximum flow capacity of conduit 10.

Duct 42 includes a plurality of pipes 44 arranged in an array of two rows and ten columns making up a total of twenty pipes 144. As seen in FIG. 8, pipes 144 are oriented so that lower end 46 of pipes 144 are positioned within lower region 26 of conduit 10 (see FIG. 10). Upper end 48 of pipes 144 extend partially above connecting section 74 of barrier 20 into gap region 40 and partially through an upper region of connecting section 74 to open into a higher region 27 of barrier 20, as best seen in FIG. 11.

Figure 9:
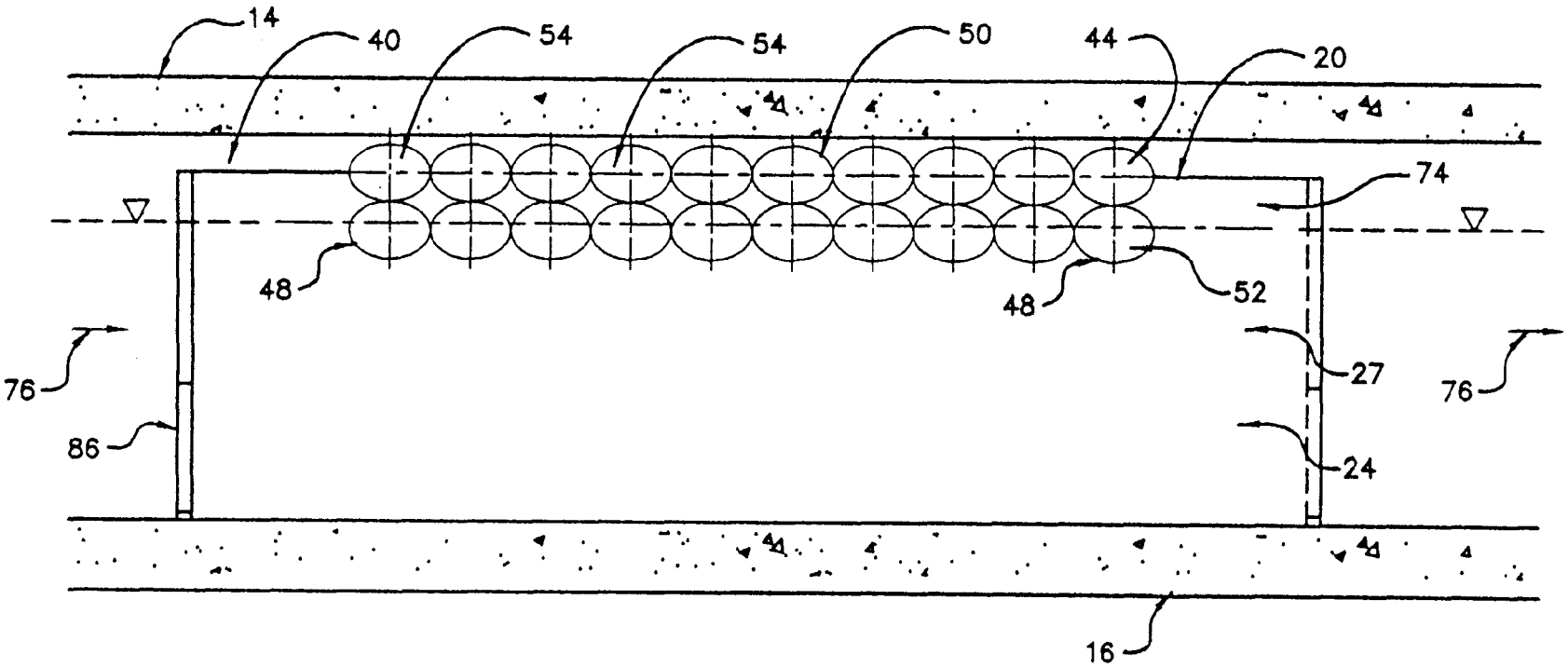
FIG. 9 is a side sectional view of the apparatus of FIG. 8, along line 9—9 of FIG. 8.

The alternate embodiment includes upper row 50 and lower row 52 of pipes 144. Referring to FIG. 9, pipes 144 of upper row 50 partially extend into gap region 40. The lower portion 54 of upper row 50 passes through connecting section 74 of barrier 20. Lower row 52 of pipes 144 extend through openings in connecting section 74 so that upper end 48 extends into higher region 27 of downstream side 24 of barrier 20. Similar to that described with respect to the first embodiment, it would be obvious to increase or decrease the size of gap region 40 to permit more or less of pipes 144 to extend over connecting section 74, rather than through openings in connecting section 74.

Referring to FIG. 10, pipes 144 are angled from the vertical, that is they are angled from a plane extending vertically and perpendicularly from bottom wall 80 of conduit 10. Pipes 144 are angled from the vertical at offset angle 68.

As well, with reference to FIG. 8, pipes 144 are also angled with respect to a plane perpendicular to section 74 at angle 90.

Offset angle 68 and angle 90 result in pipes 144 oriented such that first end or lower end 46 of pipes 144 are positioned further away from connecting section 74 as compared to second or upper end 48. Lower end 46 is also positioned further in an upstream direction from downstream section 72 as compared to upper end 48. This positions pipes 144 in a manner which facilitates flow of water through pipes 144 from upstream side 22 to downstream side 24 of barrier 20. Preferably offset angle 68 is between 45 and 30 degrees and angle 90 is between 0 and 45 degrees. Optimally offset angle 68 is about 30 degrees and angle 90 is about 30 degrees.

Referring to FIG. 10, compressed air is supplied into pipes 144 by means of compressed air system 56. System 56 includes air compressor unit 58 located in an area outside of conduit 10. Air pipe 60 extends from unit 58 downwardly in a vertical orientation through upstream side 22 of barrier to connect with lower portion 62 of pipe 60. Lower portion 62 is connected to a plurality of smaller diameter air passages 64 which are, in turn, connected to a plurality of air nozzles 66. Lower portion 62 extends along bottom wall 80 in a direction parallel to wall 84. Preferably a nozzle 66 is positioned along the central axis of each pipe 144 to direct compressed air into lower end 46 of each pipe 144 along that central axis.

Figure 12:
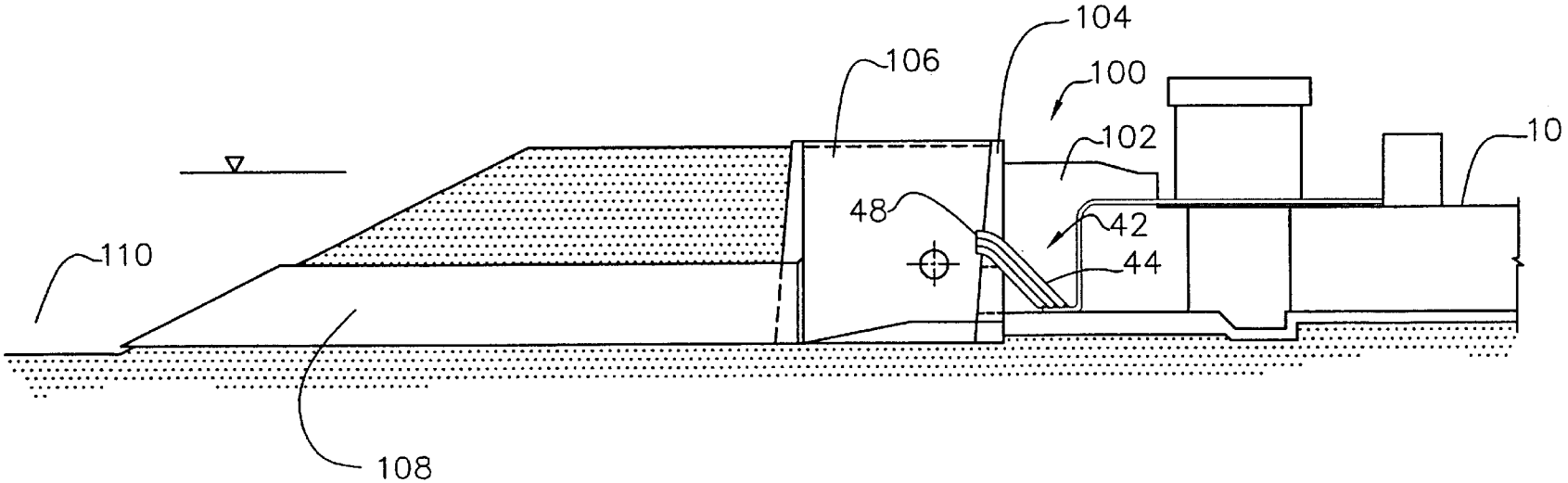
FIG. 12 is a side view of the discharge end of the conduit system of FIGS. 1 and 2.
Figure 13:
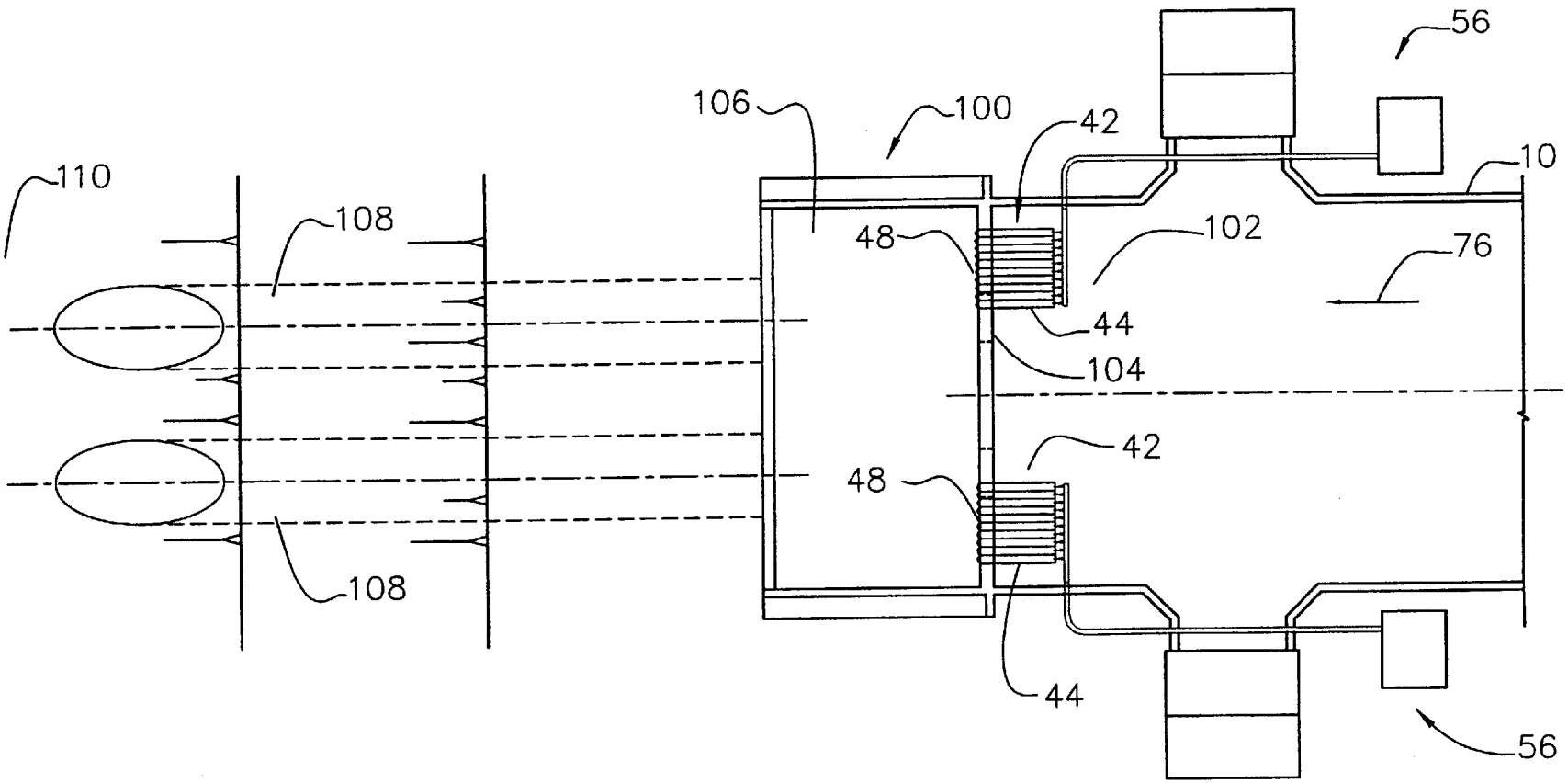
FIG. 13 is a top plan view of the discharge end of the conduit system of FIG. 12.

FIGS. 12 and 13 depict the downstream end of conduit 10 which includes discharge system 100 to discharge water from the downstream end of conduit 10 into river 110. Conduit 10 terminates at end region 102 adjacent end wall 104. A pair of ducts 42 which includes a plurality of pipes 44 are positioned adjacent wall 104 in a manner similar to that as described with the preferred embodiment in conjunction with barrier 20. Air compressor system 56 is used to direct compressed air into pipes 44 in a similar manner as previously discussed. Upper end 48 of pipes 44 extend through wall 104 into tank 106. This lifts water to tank 106 at a level above the level of a pair of exit conduits 108 connecting tank 106 with river 110 through which water is discharged from tank 106 into river 110.

Operation

The operation of the preferred embodiment will now be discussed with reference to FIGS. 1 through 7. Water flowing through conduit 10 during periods of normal water flow within the normal flow capacity of conduit 10, such as that depicted in FIG. 2 at water level 112 will normally flow through open flap gate 28 relatively unimpeded by apparatus 18. During normal periods of water flow, apparatus 18 is not operational as air compressor unit 58 is not activated and no air is flowing into pipes 44.

Referring to FIG. 1, during periods of heavy water flow, which may result from periods of heavy rainfall or large snow melt, flap gates 28 are closed to sealingly engage with barrier 20 preventing water flow past flap gate 28. Flap gates 28 close automatically on activation of unit 58 due to the increase in water pressure at the downstream side of barrier 20 as compared to the upstream side as a result of operation of apparatus 18 as discussed below. Apparatus 18 is activated by activating unit 58 which causes air to flow through air pipe 60, lower portion 62, air passages 64 and into and through nozzle 66. This forces air axially into pipes 44 which causes the water to mix with the air within pipe 44. The air and water mixture in pipe 44 rises in relation to water outside pipe 44. This draws water from lower region 26 of conduit 10 into the first or lower end 46 of pipes 44 upwardly through pipe 44 to upper end 48 where the water and air mixture is discharged into higher region 27 of conduit at the downstream side 24 of barrier 20. As depicted in FIG. 4, in essence this lifts the water flowing in the upstream side of barrier 20 which is at level 112 to a higher downstream water level 114 which increases the flow of water through conduit 10 due to the larger water pressure at the downstream side of a barrier as compared to the upstream side of the next adjacent downstream barrier in conduit 10. As apparatus 18 are positioned in spaced relationship along conduit 10 the water level is raised at the downstream side 24 of each barrier to physically increase the water pressure causing an increased water flow along conduit 10 to barrier 20 and ultimately to wall 104 where the water is lifted into tank 106 and then discharged through conduits 108 into river 110.

The alternate embodiment operates in a similar manner as compared to the preferred embodiment and will be discussed with reference to FIGS. 8 through 11. Water flowing in the direction of water flow 76 will flow through open flap gates 86 and 88 during periods of normal water flow. However during periods of heavy water flap gates 86 and 88 close and apparatus 18 is activated. Air compressor unit 58 (FIG. 10) causes compressed air to move down air pipe 60, lower portion 62 and air passage 64 to air nozzle 66 located in lower end 46 of pipes 144. This draws water in lower region 26 into lower end 46 and upwardly along pipes 144 with compressed air from nozzle 66. The air and water mixture is discharged out of upper end 48 into higher region 27 at the downstream side 24 of barrier 20. The water level 112 (FIG. 10) at the upstream side of connecting section 74 is lower than water level 114 (FIG. 11) at the downstream side of the connecting section. The alternate embodiment has the advantage of permitting any number of rows of pipes 144 aligned with connecting section 74 by varying the length of connecting section 74 appropriately to accommodate the desired number of pipes 144.

I claim:

1. An apparatus for increasing the flow of a liquid in a conduit, comprising:

a barrier for positioning in the conduit to prevent flow of at least some of the liquid past the barrier;

a duct comprising a first end for positioning within a lower region of the conduit upstream of the barrier and a second end positioned above the first end at the downstream side of the barrier to direct flow of liquid through the duct from the lower region of the conduit upstream of the barrier to a higher region above the lower region downstream of the barrier; and an air pump for communicating with the duct to force air into the first end of the duct under sufficient pressure to mix with the liquid in the area of the first end of the duct and flow through the duct and out the second end of the duct to the downstream side of the barrier.

2. The apparatus as described in claim 1 wherein the duct comprises a plurality of parallel, aligned pipes, each pipe extending from the first end to the second end of the duct for directing a portion of the flow of liquid through the pipe from the lower region upstream of the barrier to the higher region downstream of the barrier.

3. The apparatus as described in claim 2 wherein the pipes are arranged in a symmetrical pattern about a central longitudinal axis of the duct.

4. The apparatus as described in claim 3 wherein the outer periphery of the plurality of pipes is circular-shaped about the said axis.

5. The apparatus as described in claim 3 wherein the plurality of pipes are arranged in a diamond pattern.

6. The apparatus as described in claim 3 wherein the plurality of pipes are arranged in a square pattern.

7. The apparatus as described in claim 2 wherein the plurality of pipes are all the same diameter.

8. The apparatus as described in claim 7 wherein the diameter of the plurality of pipes is between about 5 millimeters and 30 millimeters.

9. The apparatus as described in claim 1 wherein the barrier defines a gap region of the conduit above the barrier and wherein at least a portion of the second end of the duct extends through the gap region to direct the liquid through the duct from the lower region of the conduit upstream of the barrier to a region above the lower region downstream of the barrier.

10. The apparatus as described in claim 1 wherein the air pump comprises an outlet for directing air under pressure from the air pump to the first end of the duct.

11. The apparatus as described in claim 10 wherein the outlet further comprises a nozzle oriented toward the first end of the duct to direct the flow of pressurized air into the first end.

12. The apparatus as described in claim 10 wherein the outlet comprises a plurality of outlet openings each outlet opening oriented to direct a portion of the flow of pressurized air into the first end of the duct.

13. The apparatus as described in claim 2 wherein the air pump comprises an outlet for directing air under pressure from the air pump to the first end of the duct and wherein the outlet comprises a plurality of outlet openings each outlet opening oriented to direct a portion of the flow of pressurized air into an opposite corresponding one of the plurality of pipes.

14. The apparatus as described in claim 13 wherein the number of outlet openings is the same as the number of pipes.

15. The apparatus as described in claim 13 wherein each outlet opening comprises a nozzle oriented toward the corresponding opposite pipe to direct the flow of pressurized air into that pipe.

16. The apparatus as described in claim 15 wherein the nozzles have a diameter substantially less than the diameter of the corresponding pipe and wherein the nozzle extends into the pipe to direct the flow of pressurized air into that pipe.

17. The apparatus as described in claim 1 wherein the duct comprises an upstream portion defined by the first end and that portion of the duct extending from the first end to an area adjacent the upstream side of the barrier and wherein the upstream portion is angled at an offset angle away from the plane of the barrier such that when in use the first end of the duct is located further away from the barrier than the rest of the upstream portion of the duct.

18. The apparatus as described in claim 17 wherein the offset angle is between 0 degrees and 45 degrees.

19. The apparatus as described in claim 17 wherein the offset angle is about 30 degrees.

20. A conduit section for use in a conduit system, comprising:

a conduit housing comprising connecting means for connecting the conduit housing with an adjacent conduit housing;

a barrier positioned in the conduit housing dimensioned to prevent flow of at least some of the liquid past the barrier when in use;

a duct comprising a first end positioned within a lower region of the conduit upstream of the barrier and a second end positioned above the first end at the downstream side of the barrier to direct flow of liquid through the duct from the lower region upstream of the barrier to a higher region above the lower region downstream of the barrier;

an air pump communicating with the duct to force air into the first end of the duct under sufficient pressure to mix with liquid in the area of the first end of the duct and flow through the duct and out the second end of the duct to the downstream side of the barrier.

21. A conduit system for transporting liquids in the conduit comprising:

a conduit housing for retaining the liquid within the conduit;

a plurality of barriers aligned along the conduit at pre-determined intervals, each barrier dimensioned to prevent flow of at least some of the liquid past the barrier;

a duct disposed adjacent each barrier, comprising a first end positioned within a lower region of the conduit upstream of the barrier and a second end positioned above the first end at the downstream side of the barrier, the duct directing flow of liquid from the lower region upstream of the barrier to a higher region above the lower region downstream of the barrier; and a plurality of air pumps communicating with the duct to force air into the first end of the duct under sufficient pressure to mix with liquid in the area of the first end of the duct and flow through the duct and out the second end of the duct to the downstream side of the barrier.

22. A method for increasing the flow of liquid in a conduit, comprising the steps of:

(a) arranging a plurality of barriers of sufficient height to prevent backflow of liquid in the conduit from the downstream side to the upstream side of the barrier at pre-determined intervals in the conduit, the barriers dimensioned in size to prevent flow of at least some of the liquid past the barrier;

(b) providing a duct adjacent the barrier with a first end positioned within a lower region of the conduit upstream of the barrier and a second end positioned above the first region at the downstream side of the barrier to direct flow of liquid through the duct from the lower region of the conduit upstream of the barrier to a higher region above the lower region downstream of the barrier;

(c) pumping sufficient air into the first end of the duct to mix with liquid adjacent the first end of the duct and flow through the duct and out the second end of the duct to the downstream side of the barrier.

23. The apparatus as described in claim 1 wherein the barrier comprises a gate in the lower region of the conduit to allow liquid to flow from upstream of the barrier to downstream of the barrier without passing through the duct.

24. The apparatus as described in claim 23 wherein the gate further comprises gate actuator for opening the gate upon receiving a signal.

25. The apparatus as described in claim 24 wherein the gate is biased in its open position and wherein the actuator comprises a pressure sensor whereby the actuator closes the gate upon the pressure of liquid on the gate exceeding a pre-determined value indicative of water flow approaching the flow capacity of the conduit.

26. The apparatus as described in claim 23 further comprising adjuster for adjusting the pre-determined pressure upon which the gate closes.

27. The apparatus as described in claim 1 wherein the barrier comprises an upstream section preventing flow of at least some of the liquid past the upstream section, a downstream section preventing flow of at least some of the liquid past the downstream section and a connecting section connecting the upstream section to the downstream section preventing flow of at least some of the liquid past the connecting section wherein the upstream and downstream sections are oriented perpendicularly to the longitudinal axis of the conduit and the connecting section is oriented parallel to the longitudinal axis of the conduit.

28. The apparatus as described in claim 27 wherein the connecting section comprises a downstream and upstream side and wherein the duct is positioned adjacent the connecting section such that the first end of the duct is adjacent the upstream side of the connecting section and the second end of the duct is positioned to direct liquid to the downstream side of the connecting section.

29. The apparatus as described in claim 28 wherein the duct is angled with respect to a plane perpendicular to the longitudinal axis of the conduit with the first end positioned closer to the upstream section than the second end.

30. The apparatus as described in claim 28 wherein the duct is angled with respect to the plane of the connecting section with the first end positioned further away from the connecting section than the rest of the duct.

* * * * *